US006924038B1

(12) United States Patent
Hardy et al.

(10) Patent No.: US 6,924,038 B1
(45) Date of Patent: Aug. 2, 2005

(54) STOP-OFF FOR DIFFUSION COATING

(75) Inventors: Bryan Anthony Hardy, Kings Newton (GB); David Arthur Goddard, Stoke-on-Trent (GB); Edward Hugh Shaw, Leek (GB)

(73) Assignees: Chromalloy United Kingdom Limited (GB); Wade Ceramics Limited (GB)

( * ) Notice: Subject to any disclaimer, the term of this patent is extended or adjusted under 35 U.S.C. 154(b) by 0 days.

(21) Appl. No.: 09/937,545

(22) PCT Filed: Mar. 28, 2000

(86) PCT No.: PCT/GB00/01186

§ 371 (c)(1),
(2), (4) Date: Jan. 22, 2002

(87) PCT Pub. No.: WO00/58531

PCT Pub. Date: Oct. 5, 2000

(30) Foreign Application Priority Data

Mar. 29, 1999 (GB) ..... 9907244

(51) Int. Cl.[7] ..... C23C 16/04

(52) U.S. Cl. ..... 428/446; 428/448; 428/195.1; 428/450; 264/603; 264/646; 264/674; 264/681; 264/122; 427/252; 427/282

(58) Field of Search ..... 428/446, 448, 428/195.1, 450; 264/603, 646, 674, 681, 122; 427/252, 282

(56) References Cited

U.S. PATENT DOCUMENTS 4,128,522 A 12/1978 Elam ..... 260/32.8
6,332,926 B1 * 12/2001 Pfaendtner et al. ..... 118/721

FOREIGN PATENT DOCUMENTS

DE 1298830 7/1969 ..... C23C/9/02
GB 2008621 6/1979 ..... C23C/11/00

OTHER PUBLICATIONS

Database WPI, Section Ch, Week 198146 Derwent Publications Ltd., London, GB; AN 1981–84937D. XP002141086 & SU 804715A (S Ranches Mech Elec), Feb. 15, 1981 abstract.

* cited by examiner

*Primary Examiner*—Timothy Meeks
(74) *Attorney, Agent, or Firm*—Mitchell D. Bittman

(57) ABSTRACT

A mask suitable for protecting a portion of a substrate surface against diffusion coating of the substrate with a metal, which mask comprises a ceramic material comprising silica and an inert refractory diluent and a metal or metal alloy, wherein the metal or metal alloy is one which is reactive with silicon thereby minimising or preventing siliconisation of the substrate with silicon in the ceramic material under conditions of diffusion coating, and which is reactive with the metal being applied by diffusion coating thereby preventing diffusion coating of the portion of the substrate surface it is desired to protect.

20 Claims, 2 Drawing Sheets

STOP-OFF FOR DIFFUSION COATING

Figure 1:
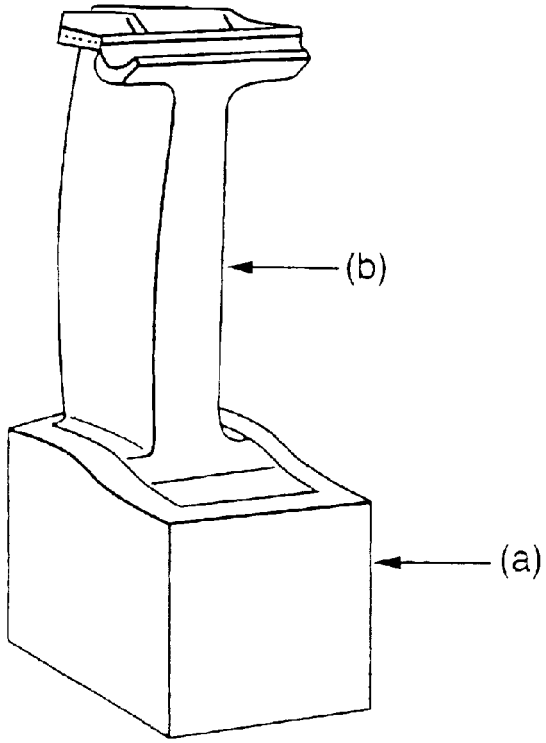

The present invention relates to a mask for use in diffusion coating, to its preparation and its use in a diffusion coating process. The invention further relates to a composition/mixture of components suitable for use in preparing the mask.

Diffusion coating of substrate surfaces, such as high temperature superalloys, to introduce metal into the substrate surface, is typically carried out at high temperatures. Under coating conditions the metal which it is desired to introduce pervades to all substrate surfaces unless special precautions are taken to prevent this. Indeed, in many applications, it is important to restrict coating of the substrate to certain areas. For example, when the substrate is a jet engine turbine blade, it is important that the turbine roots remain uncoated if mounting dimension tolerances are to be maintained.

A number of methods of masking a substrate surface to prevent diffusion coating have been proposed. Some methods involve the preparation and application of stop-off pastes, slurries or resins. These are typically metal loaded compositions in which the metal serves to react with the metallic coating vapours, thereby preventing metal deposition in unwanted areas. The use of this kind of masking technique is labour and time intensive and requires the careful application of the composition to that area of the substrate to be protected, followed by drying of the composition. Often a number of layers of composition need to be applied before diffusion coating. After coating, the mask must be fractured and removed. In this respect, the use of such stop-off compositions is also uneconomical due to their "one off" usage. It has also been observed that the compositions tend to exhibit reduced effectiveness at higher coating temperatures: at elevated temperatures components of the mask composition can interact with the substrate surface to the detriment of the metallurgy of the component.

As an alternative, it has also been proposed to use plain (non metal-containing) ceramic caps to shield substrate surfaces. Silica based ceramic materials have been used previously. These have the benefit that they may be re-usable but are only effective at lower temperature range short cycle processes because of the danger of siliconisation of the protected area of the substrate due to silicon in the ceramic.

The present invention seeks to overcome these problems by providing a re-usable diffusion coating mask which provides a higher level of protection, which does not interact with the substrate surface even at higher coating temperatures or relatively longer coating cycles, and which minimises consumables, depositing and removal costs.

It has now been found that incorporating a metal or metal alloy into a silica-based ceramic material prevents the siliconisation problem encountered with the previously used plain ceramic caps. This enables the masks to be used at higher temperatures or over longer coating cycles. The metal or alloy used is also capable of reacting with the metallic coating vapours being applied thereby preventing diffusion coating in areas of a substrate protected by such material. The finding that the metal or alloy is able to prevent both siliconisation and diffusion coating is central to the present invention.

Accordingly, the present invention provides a mask suitable for protecting a portion of a substrate surface against diffusion coating of the substrate by metallic vapours during a pack or vapour coating process. This mask comprises a composite material containing silica and an inert refractory diluent and a metal or metal alloy, wherein the metal or metal alloy is one which is capable of reacting with silicon thereby preventing siliconisation of the substrate with silicon from the composite material under conditions of diffusion coating and which is capable of reacting with the metal being applied by diffusion coating thereby preventing diffusion coating of the portion of the substrate surface it is desired to protect.

The composite material usually contains between 5 and 50% by weight metal or metal alloy based on the total weight of the composite material. In a preferred embodiment, the amount of metal or metal alloy is between 10 and 20% by weight. Single metals or metal alloys may be used, or mixtures of different metals and/or metal alloys. When mixtures are used, the total amount of metal and/or metal alloy generally falls within these limits.

The metal or metal alloy is usually present in the ceramic matrix in the form of particles. The particles may vary in size from fine powders to granules depending upon application. Typically, the particles range between 25 and 150 microns. Particles of 75 microns or finer are typically used.

Examples of metals which may be used in practice of the present invention include nickel, cobalt, chromium, molybdenum and tungsten. Of these, the use of nickel or cobalt is preferred, particularly nickel.

Useful metal alloys which may be used include alloys based on combinations of the following metals: nickel, cobalt, chromium, aluminium, molybdenum, tungsten, vanadium, tantalum, titanium and hafnium. Of these, the use of nickel-chromium alloys is preferred.

The composite material is a ceramic which contains silica and an inert refractory diluent. The latter prevents sintering to the surface being masked. Refractory diluents of alumina, aluminosilicates and feldspar (plus trace elements) are typically employed. The use of alumina is preferred. The silica is usually present in the composite material (i.e. excluding the metal or metal alloy) in an amount of at least 5% by weight. The amount of silica does not usually exceed 30% by weight based on the weight of the composite material. More typically, the amount of silica is from 10 to 15% by weight. The proportion of silica in the composite can be adjusted to optimise the structural integrity of the mask although here it will be appreciated that any variation in silicon content may require variation also in the content of metal or metal alloy required to inhibit siliconisation. Determination of the amount of metal or alloy for a particular silicon content is within the ability of one skilled in the art.

In a preferred embodiment of the invention, the ceramic is an aluminosilicate. Thus, the masks may be conveniently prepared using clays. Useful clays are commercially available and include Puraflow-DM and Bentonite. As a consequence of using a clay, the ceramic will also include other compounds and minerals commonly found in clays. In an embodiment of the invention the mask comprises 10 to 20% by weight nickel dispersed in an aluminosilicate ceramic matrix.

The metal or alloy in the mask must be in reduced form to ensure that it is available for reaction both with the silicon present in the composite material and with the metal which is being applied by diffusion coating. This requirement has particular implications with respect to how the mask is prepared. Thus, the present invention further provides a process for preparing the mask, which process comprises mixing the metal or metal alloy with a ceramic material containing silica and an inert refractory diluent, shaping the resultant mixture into a desired configuration to form a blank, and then either:

(a) firing the blank in a reducing atmosphere to prevent oxidation of the metal or metal alloy; or (b) firing the blank in an oxidising atmosphere followed by treatment in a reducing atmosphere to reduce the metal or metal alloy.

In one embodiment of this process the blank is fired in a reducing atmosphere, such as hydrogen or other reducing atmosphere. Firing typically takes place at a temperature of between 1150 and 1300° C. for a period of time of from 30 minutes to 3 hours at temperature.

In the other embodiment of the process, the blank is initially fired in a conventional manner, i.e. without special steps to prevent oxidation of the metal or metal alloy. In this case, the initial firing typically also takes place at a temperature of between 1150 to 1300° C. for a period of time of 30 minutes to 3 hours at temperature. Subsequent to this firing, a conditioning treatment is then necessary in order to achieve reduction of the metal or metal alloy. This reduction may be achieved by heat-treatment in a reducing atmosphere (e.g. hydrogen or other) at a temperature of between 900 and 1200° C. for a period of at least one hour.

The conditions required to reduce the metal or metal alloy to the desired extent may be determined easily. For example, this may be done on a trial and error basis by considering the effectiveness of the mask in the diffusion coating process. In this way, it is also possible to optimise the amount of metal or metal alloy which needs to be present in the mask.

In certain cases the extent to which the metal or alloy has been reduced can be assessed visually as the colour of the metal or alloy changes with oxidation/reduction. For instance, when the mask contains nickel reduction leads to a colour change of the mask from green (nickel oxide) to grey (nickel). To achieve effective masking, the metal or alloy should be substantially in reduced form through the entire mask. Thus, for a nickel-containing mask, the grey colour should be observed through any section of the mask.

The present invention also provides a mixture of components suitable for preparing the masks described herein. Thus, the ceramic material and metal or metal alloy may be provided in ready to use granulate form.

Caps may be formed by conventional techniques such as wet pressing using a suitable die or by other ceramic forming methods. The caps so-formed may then be fired as described above.

The masks of the present invention may be used in diffusion coating of aluminium (aluminising) or chromium (chromising), more typically aluminium. The masks may be used in the coating of a variety of components but are expected to have particular usage in the diffusion coating of turbine blades, for example of jet engines, where it is desired to prevent coating of the blade root. Jet engine turbine blades are typically formed from nickel-based superalloys, and when applied to such components, the metal present in the mask is usually nickel or a nickel-based alloy.

Typically, the mask is provided in the form of a cap which is fitted over the part of the substrate to be protected. Such an embodiment is illustrated in FIG. 1 which shows a cap (a) fitted to the root of a jet engine turbine blade (b). In this embodiment, the fit of the cap does not have to follow the exact profile of the area being protected although the cavity of the cap into which the substrate (component) fits should be as well-fitting as manufacturing constraints permit. The gap between the substrate and the cap is typically 0.5 mm or less, preferably 0.25 mm or less. If there is insufficient gap, the substrate may become wedged in the cap and thus be difficult to remove without damaging the cap which is, of course, intended to be re-usable. It is important when preparing the cap for a substrate that contraction/expansion of the cap and substrate during coating be taken into account. Shrinkage of the cap during firing should also be accounted for. If the cavity of the cap as prepared is too small, this may be remedied by machining.

The masks of the invention may be used in conventional diffusion coating techniques. For example, aluminising may be carried out by a pack process at a temperature of from 800 to 1050° C. for from 1 to 20 hours at temperature, for instance, aluminising at 875° C. for. 20 hours would be a typical coating cycle.

The masks of the invention have the advantage of being re-usable, and may be employed on multiple occasions before their mechanical or protective integrity is diminished to below a useful level.

The basis for the present invention is the choice of a metal or metal alloy which will react with silicon in the composite and with the metallic coating vapours. With reference to the use of nickel as metal and aluminium as the diffusion coating, the principle underlying the invention is believed to be as follows.

The aluminising operation causes dissociation of silicate bonds in the ceramic. The reaction (1) is believed to be oxidation of aluminising vapour to alumina coupled with silica reduction. The silica is then incorporated into the nickel particles forming nickel silicide (NiSi) (2). The latter reaction removes potentially active silicon from the system thereby preventing the siliconisation problem associated previously with plain ceramic masks.

$$Al+SiO_2 \rightarrow Al_2O_3+Si \quad (1)$$

$$Si+Ni \rightarrow NiSi \quad (2)$$

Depletion of silicate bonding within the ceramic tends to reduce the strength of the mask although this is not sufficient to prevent the mask being used on several occasions with effectiveness intact.

Some surface depletion in the substrate of elements such as aluminium, chromium and titanium in the area protected by the mask may occur, but this is only to an extent similar to the use of conventional stop-off slurry techniques. This effect may be minimised by including in the ceramic material a metal alloy (e.g. Ni—Cr) at the expense of, or in addition to, pure metal.

The invention will now be illustrated by the following non-limiting examples.

EXAMPLE 1

A ceramic material having the following composition (approx.) was blended with 20% by weight of 99.8% pure nickel powder, at least 40% of which passed through a 38 micron (400 mesh) sieve.

| | |
|---|---|
| Alumina | 84% |
| Titania | 0.02% |
| Silica | 10.7% |
| Ferric oxide | 0.26% |
| Lime | 3.14% |
| Magnesia | 1.09% |
| Potash | 0.24% |
| Soda | 0.23% |

The so-blended material was formed into caps designed to fit the root end of an H.P. turbine blade in MarM002 material. This was done by pressing the mixture using a die of the desired configuration. The caps were then "fired" at a temperature of 1220° C. for 2 hours at temperature. The resultant caps were coloured green due to the presence of nickel in oxidised form. The caps were subsequently treated in a reducing atmosphere (hydrogen) at a temperature of 1100° C. for one hour. The green colour changed to grey indicating reduction to nickel.

Figure 2:
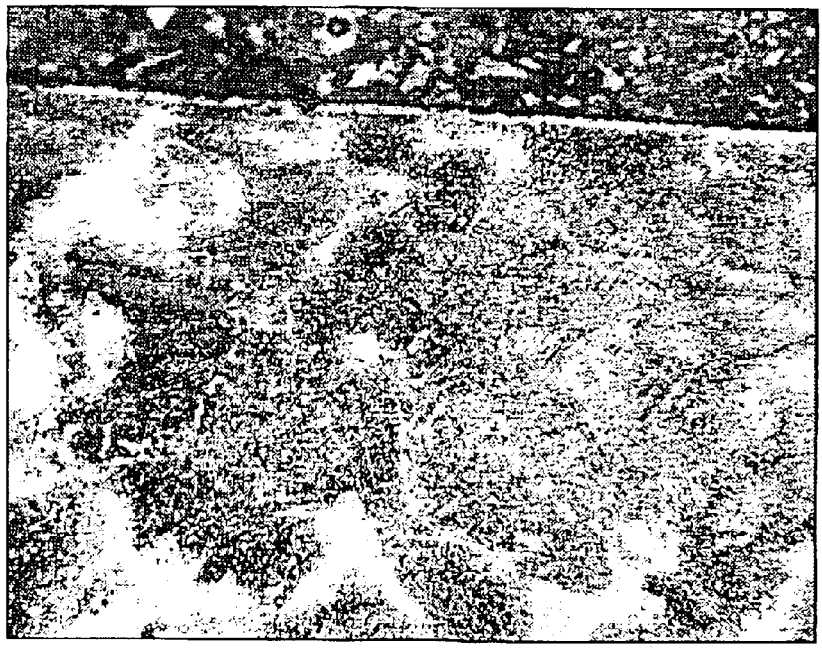
Figure 3:
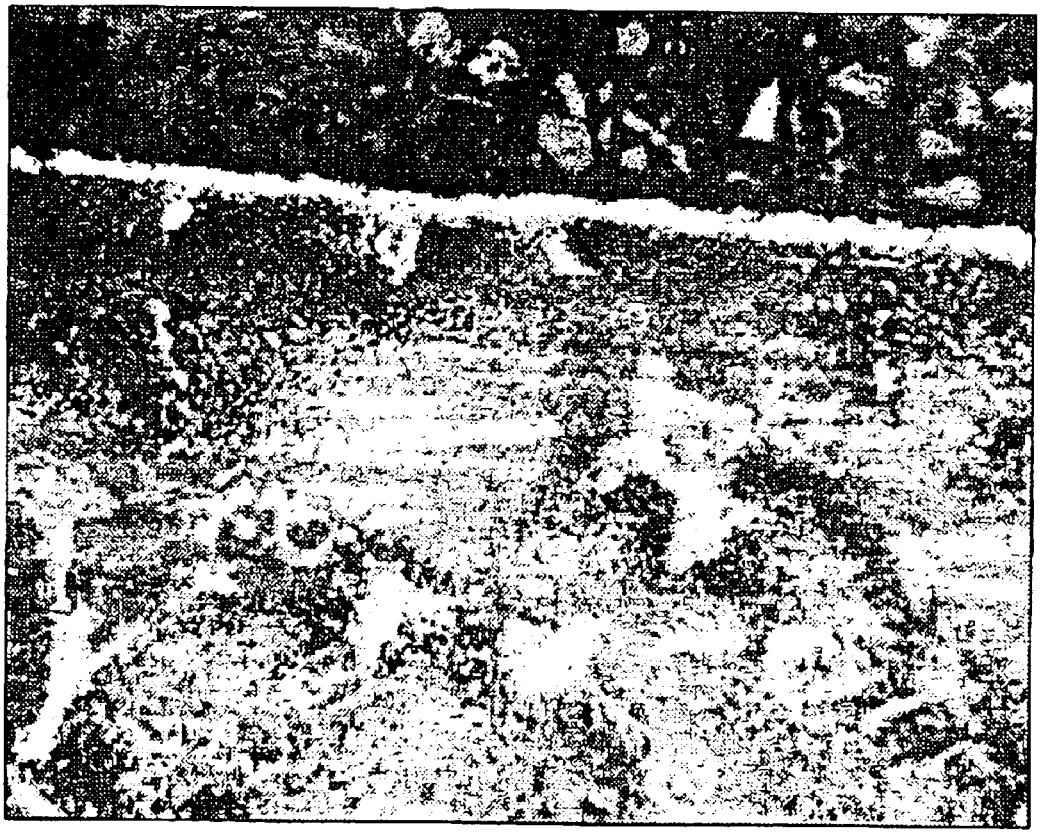

The caps were then used to protect the blade roots during pack aluminising for 20 hours at 875° C. After removal of the caps, the metallurgy of the protected roots was analysed. No evidence of alumising or siliconising was observed and the level of surface denudation was at least equivalent to that found using conventional stop-off slurries. FIG. 2 shows the level of surface denudation on a blade surface protected with the subject invention. FIG. 3 shows the level of surface denudation on a blade surface protected using a conventional slurry technique.

EXAMPLE 2

Adopting the same procedure as Example 1, caps were prepared by blending a ceramic material having the composition (approx.) given below with 10% by weight of 200 mesh 99.8% pure nickel powder, at least 40% of which passed through a 38 micron (400 mesh) sieve.

| | |
|---|---|
| Alumina | 85.58% |
| Titania | 0.13% |
| Silica | 13.87% |
| Ferric oxide | 0.29% |
| Lime | 0.08% |
| Magnesia | 0.11% |
| Potash | 0.36% |
| Soda | 0.57% |

The caps were used to protect the roots of MarM002 turbine blades during aluminising at 875° C. for 20 hours. After the caps were removed and the root structure analysed, identical results to Example 1 were observed.

EXAMPLE 3

Example 1 was followed to prepare caps with and without nickel addition. Both types of cap were fired at 1220° C. for 2 hours at temperature followed by reductive conditioning at 1100° C. for 1 hour. The caps were then used as stop-offs on a CMSX4 material (a nickel-cobalt superalloy) during aluminising for 20 hours at 875° C. After this the metallurgy of the protected surface was analysed. The caps without nickel led to substantial siliconising of the substrate surface. In contrast, no siliconising was observed for the caps containing nickel in accordance with the present invention.

EXAMPLE 4

A ceramic material including nickel powder (75 micron (200 mesh) to 38 micron (400 mesh)) and having the following composition (approx.) was prepared.

| | |
|---|---|
| Alumina | 71.31% |
| Titania | 0.10% |
| Silica | 11.55% |
| Ferric oxide | 0.24% |
| Lime | 0.06% |
| Magnesia | 0.09% |
| Potash | 0.30% |
| Soda | 0.48% |
| Nickel | 15.87% |

This composition was pressed into a cap designed to fit the root end of a MarM002 jet engine turbine blade. The cap was then fired and reduced as in Example 1. On fitting the cap to the root of the blade the gap between the wedge faces of the blade and the cap was found to be 0.25 nun.

The capped-blade was then placed in a pack aluminising retort for 20 hours at 875° C. After this, the cap was removed and the root of the blade examined. It was clear from visual inspection that the area of the blade protected by the cap had not been aluminised or siliconised. Sections taken through the root for micro-examination confirmed this and that there was a minimum level of denudation. The same cap was re-used on a further four occasions with similarly acceptable results.

EXAMPLE 5

A similar cap/blade combination to that used in Example 4 was subjected to aluminising at 100° C. for three hours. Visual appearance again suggested that the cap had prevented any aluminising of the root, and this was confirmed by micro-examination. There were no signs of siliconisation. There was a slight increase in surface denudation relative to Example 4, but this was to be expected in view of the higher aluminising temperature.

What is claimed is:

1. A mask suitable for protecting a portion of a substrate surface against diffusion coating of the substrate by metallic vapours during a pack or vapour coating process which mask comprises a composite material containing silica and an inert refractory diluent and a metal or metal alloy, wherein the metal or metal alloy is one which is capable of reacting with silicon thereby preventing siliconisation of the substrate with silicon from the composite material under conditions of diffusion coating and which is capable of reacting with the metal being applied by diffusion coating thereby preventing diffusion coating of the portion of the substrate surface it is desired to protect.

2. A mask according to claim 1, wherein the metal or metal alloy is present in the composite material in an amount of 5 to 50% by weight based on the total weight of the mask.

3. A mask according to claim 2, wherein the metal or metal alloy is present in the composite material in an amount of 10 to 20% by weight based on the total weight of the mask.

4. A mask according to claim 2, wherein the metal in the mask is selected from nickel, cobalt, chromium, molybdenum and tungsten.

5. A mask according to claim 4, wherein the metal in the mask is nickel.

6. A mask according to claim 5, which comprises from 10 to 20% by weight nickel dispersed in an aluminosilicate ceramic matrix.

7. A mask according to claim 2, wherein the metal alloy is an alloy based on a combination of metals selected from nickel, cobalt, chromium, aluminium, molybdenum, tungsten, vanadium, tantalum, titanium and hafnium.

8. A mask according to claim 7, wherein the metal alloy is a nickel-chromium alloy.

9. A mask according to claim 2, wherein the inert refractory diluent comprises alumina, aluminosilicate or feldspar.

10. A mask according to claim 9, wherein the composite material comprises an aluminosilicate ceramic.

11. A mask according to claim 2, wherein the silica is present in the composite material excluding the metal or metal alloy in an amount of at least 5% by weight.

12. A mask according to claim 2, wherein the silica is present in the composite material excluding the metal or metal alloy in an amount of from 10 to 15% by weight.

13. A mask according to claim 1 in the form of a diffusion coating cap.

14. A process for preparing a mask as defined in claim 1, which process comprises mixing the metal or metal alloy with a ceramic material containing silica and an inert refractory diluent material, shaping the resultant mixture into a desired configuration to form a blank, and then either:

(a) firing the blank in a reducing atmosphere to prevent oxidation of the metal or metal alloy; or (b) firing the blank in an oxidising atmosphere followed by treatment in a reducing atmosphere to reduce the metal or metal alloy.

15. A process according to claim 14, wherein the blank is in the shape of a cap.

16. A process according to claim 14, wherein in (a) the blank is fired at a temperature of from 1150 to 1300° C. for from 30 minutes to 3 hours at temperature.

17. A process according to claim 14, wherein in (b) the blank is fired in an oxidising atmosphere at a temperature of from 1150 to 1300° C. for from 30 minutes to 3 hours at temperature followed by treatment in a reducing atmosphere at a temperature of from 900 to 1200° C. for a period of at least 1 hour.

18. A process for diffusion coating with a metal a selected portion of a substrate surface, which process comprises masking the substrate surface except for the portion to be coated with a mask as defined in claim 1, subjecting the substrate to diffusion coating with the metallic vapour, and removing the mask from the substrate surface.

19. A process according to claim 18, wherein the metal which is being applied by diffusion coating is aluminium or chromium.

20. A process according to claim 18, wherein the substrate is a turbine blade and the portion of the blade protected against diffusion coating is the blade root.

* * * * *